US005529566A

United States Patent [19]

Weil

[11] Patent Number: 5,529,566

[45] Date of Patent: Jun. 25, 1996

[54] METHOD FOR CONTROLLING A SOLID-SHELL CENTRIFUGE

[76] Inventor: Hans A. Weil, Schipfe 49, CH-8001 Zürich, Switzerland

[21] Appl. No.: 334,347

[22] Filed: Nov. 2, 1994

Related U.S. Application Data

[63] Continuation-in-part of Ser. No. 803,968, Dec. 9, 1991, abandoned.

[30] Foreign Application Priority Data

Dec. 11, 1990 [CH] Switzerland ..... 03919/90

[51] Int. Cl.[6] ..... B04B 9/10; B04B 13/00

[52] U.S. Cl. ..... 494/1; 494/10; 494/7

[58] Field of Search ..... 494/1, 2, 3, 4, 494/7, 8, 9, 10, 12, 37, 55, 52, 53, 54, 82, 84; 210/145, 144, 363, 380.3; 73/1 DC, 862.49; 366/601, 79; 425/135; 318/646, 645, 644; 415/17

[56] References Cited

U.S. PATENT DOCUMENTS

| | | | |
|---|---|---|---|
| 3,307,164 | 2/1967 | Zimmer | 73/862.49 |
| 4,070,290 | 1/1978 | Crosby | 210/144 |
| 4,228,949 | 10/1980 | Jackson | 494/53 |
| 4,240,578 | 12/1980 | Jackson | 494/53 |
| 4,287,758 | 9/1981 | Swearingen | 73/862.49 |
| 4,421,502 | 12/1983 | Jakobs | 494/53 |
| 4,432,747 | 2/1984 | Posse et al. | 494/8 |
| 4,656,875 | 4/1987 | Uitermarkt | 73/862.49 |
| 4,668,213 | 5/1987 | Krämer | 494/53 |
| 4,768,389 | 9/1988 | Chszaniecki | 73/862.49 |
| 4,782,696 | 11/1988 | Suchoza et al. | 73/862.49 |

FOREIGN PATENT DOCUMENTS

| | | | |
|---|---|---|---|
| 1431973 | 2/1966 | France . | |
| 1002678 | 3/1983 | U.S.S.R. | 415/17 |

*Primary Examiner*—Timothy F. Simone
*Assistant Examiner*—Tony G. Soohoo
*Attorney, Agent, or Firm*—Spencer & Frank

[57] ABSTRACT

A method of controlling the rotation of a centrifuge including an outer bowl shell and a scroll supported in the outer bowl shell for rotation relative to the outer bowl shell. The method includes the steps of obtaining control signals representing forces acting on the scroll and controlling the rotation of the centrifuge as a function of the control signals. The method comprises the steps of measuring an axial force imparted on the scroll parallel to an axis of rotation of the scroll; generating feedback signals from values obtained from the measuring step; and controlling the rotation of the centrifuge as a function of the feedback signals.

11 Claims, 7 Drawing Sheets

METHOD FOR CONTROLLING A SOLID-SHELL CENTRIFUGE

CROSS REFERENCE TO RELATED APPLICATION

This application is a continuation-in-part of application Ser. No. 07/803,968, filed Dec. 9, 1991 now abandoned.

FIELD OF THE INVENTION

The present invention relates to a method and apparatus for controlling a solid-shell centrifuge, such as a decanter, by which control signals are obtained from the changing forces on the scroll (screw conveyor) and are used for adjusting the machine control.

BACKGROUND OF THE INVENTION

Solid-shell centrifuges of the kind here in question, work, for example, as decanters in separation processes for clarification, dewatering, wet classification, solid-liquid-extraction and such like processes. In this connection, a scroll rotates with slight gap inside a bowl shell and in the same direction. The scroll operates by means of a speed slightly different from that of the bowl shell as the conveyer element for the removal of relatively dry residue, whilst the clarified liquid on the inner shell of the bowl flows off in the opposite direction.

In order to control the separation result of the centrifuge, the differential speed or scroll speed or the height of weir plate or the amount of inflow can be controlled.

For such a control, the scroll torque has hitherto been the most important command variable. A reason therefor lies in the relative simplicity of obtaining this information, depending on the driving system, as electric or hydrostatic variable. In addition to this, with incompressibles, that is solid matter which is not further compressible, the torque is a statement of the degree of loading of the machine with solid matter and the amount thereof in the drying stage. With compressible solids, the torque is a statement which is made up on the one hand from the filling rate, and on the other hand from the degree of concentration of the solids and the shearing resistance thereof.

As a rule, the scroll torque is employed as the command variable. The reason therefore lies on the one hand in the fact that the arrangement for acquiring the torque can usually also be used as the regulating unit of the control; on the other hand, that the scroll speed control is a control which ensures the flexibility of the centrifuge over a wide field of operations at a simultaneous optimization of the results pertaining to separation engineering.

In the marginal areas of the torque, be it at extremely low torque caused by very flowable sediment, or also at extremely high torque caused by a very high concentration, difficulties occur with control systems that have the torque as command variable, which restricts the field of operation drastically or may even lead to a total breakdown of the control. With applications in which the solids phase still contains very great flow qualities, the determined torque is so low that the value thereof lies far below the mean level of the disturbance variables, which are generated by friction from individual larger particles which may be present. With applications where the degree of concentration of the solids becomes high, the control that is dependent on the torque fails as a system. Indeed, such a control is a control system by which the torque is the output variable as well as also being the input variable of the control, thus a control system with feedback, which is clearly subject to reactive coupling. The inherent frequency of such a control system which starts to oscillate, depends on the time constant of the system. By a scroll speed control dependent on the torque, the concentration time is decisive; by a feed control dependent on the torque, it is the sedimentation time and the concentration time. As long as the sediment in the storage area of the machine possesses good flow qualities, this mass is capable of "swallowing" every disturbance variable from the feed, which thus means that everywhere in this mass, the concentration, the solidification and the shearing resistance increases monotonic in centrifugal direction. If, however, the flow qualities of the sediment sink, which is the rule upon increasing solidification, this mass hence begins to develop a "memory" for feed-end disturbance variables, and the tendency towards an oscillating of the control system increases. A reduction of the control factor or intensifier factor of the control system, or the attenuation of the command variable, restrict the field of operation of the control to such an extent that the latter is no longer capable of handling a temporary larger accumulation of solids, and thus fails one of the most important purposes thereof.

OBJECT OF THE INVENTION

It is thus a primary object of the present invention to provide a method for controlling a solid-shell centrifuge of the aforementioned kind which avoids with certainty the exemplified problems of the prior art and accomplishes an optimal control under all possible operating conditions.

SUMMARY OF THE INVENTION

This is achieved according to the invention in that at least the axial forces or components thereof applied to the scroll are measured and converted to feedback signals for the adjustment.

A preferred development of the method can be seen in that the axial forces are measured place-wise or section-wise and/or at several positions of the scroll, the measured axial forces being then at least partially static.

However, the measured axial forces may also be the sum of the static and the dynamic axial forces.

Further, the method can be developed such that the dynamic axial forces are command variables of a control, in particular the scroll speed control, and, further, that the torque applied to the scroll is also used in order to obtain a signal for a scroll speed control or a control dependent upon torque.

Furthermore, in addition to the scroll speed control, a drum speed control can be undertaken. In addition to this, by means of control, in particular scroll speed control, the axial scroll load can be kept constant.

Moreover, the present invention relates to a centrifuge consisting of a bowl shell with a scroll rotating with slight gap in the same direction and with a driving system attached thereto in order to execute the method according to the invention.

This centrifuge distinguishes itself according to the invention in that dynamometer arrangements are disposed place-wise or sector-wise, singularly or in multiple in the area of the scroll in order to generate output signals as a measure of the axial forces or components thereof acting upon the scroll, said output signals adjoining a transformer stage and intensifier stage in order to generate control signals for the drive.

In this connection, the centrifuge can be developed such that the dynamometer arrangements comprise electronic or hydrostatic sensors, or axial bearings with axial force sensors, or pressure gauges on hydrostatic axial bearings.

Exemplary embodiments according to the invention will now be described more particularly with reference to the accompanying drawing.

DESCRIPTION OF THE PREFERRED EMBODIMENTS

Figure 1:
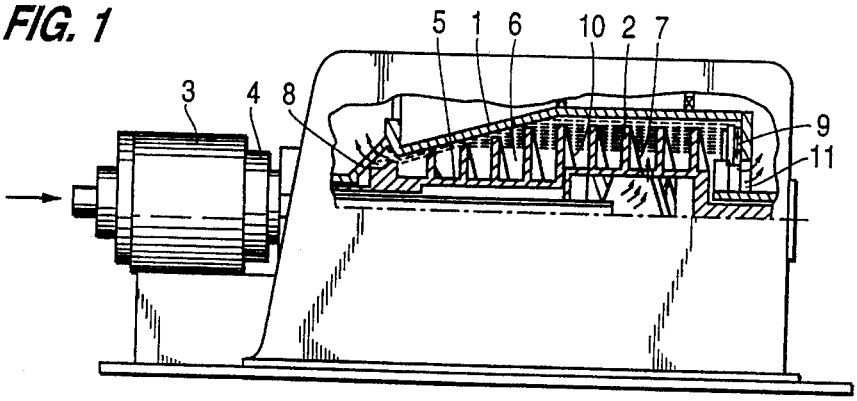
FIG. 1 is a diagrammatic, partially sectional representation of the solid-shell centrifuge suitable for carrying out the method according to the invention.

The decanter according to FIG. 1 consists of a conical tapered outer bowl shell 1 inside which a scroll 2 rotates with slight gap in the same direction. By preference, the outer bowl 1 consists thereby of a distinct cylindrical section to increase the period of dwell whilst the conical section centrifuges the residue to a large extent dry.

The scroll 2 operates in this connection through a low differential speed of, for example, 2 to 70 rpm as the conveyor for the relatively dry residue which has settled. For example, the bowl shell can rotate at 1410 rpm and the scroll at 1370 rpm, the drive of which results by way of a driving machine 3 and a gear unit 4.

Suspension is supplied by the hollow shaft 5 of the scroll 2 approximately center of the bowl chamber 6, for which radial openings 7 are found in the shell of the hollow shaft 5 of the scroll 2.

The clarified liquid flows under the effect of the centrifugal separation further along the bowl chamber and flows out through the front-end opening 11 via overflow baffles 9 at the level of the surface of the pond 10.

The scroll 2, however, conveys the residue which has settled in the middle section of the bowl 1 to the narrow conical end and throws this residue, which has been centrifuged dry to a large extent, out through the opening 8.

To influence the separation result of the centrifuge, the differential speed or the scroll speed is regulated by controlling the driving machine 3 and/or the gear unit 4.

Thus far, solid-shell centrifuges of the kind here in question are known.

Essential to the invention in this connection is that at least the axial forces or components thereof acting on the scroll are measured and converted to feedback signals for at least one scroll speed control.

Figure 2:
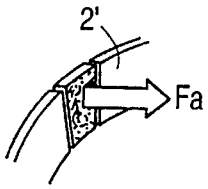
FIGS. 2 and 3 are illustrations of the axial forces here in question on the scroll of the centrifuge according to FIG. 1.
Figure 3:
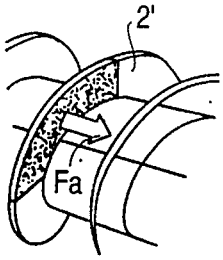
Figure 4:
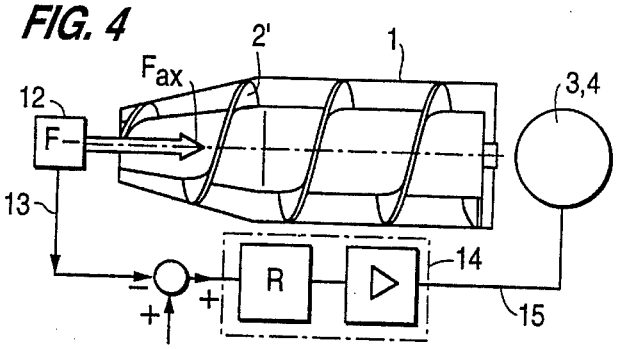
FIGS. 4 and 5 are diagrammatically indicated measuring points for obtaining the axial forces for the control according to the invention.

Such axial forces Fa or components can be measured place-wise (FIG. 2) or section-wise (FIG. 3) by means of a dynamometer arrangement 12 on the flight 2' of the scroll 2, the output signal 13 of the dynamometer arrangement 12 supplying thereby via a transformer stage and intensifier stage 14 the feedback signal or control signal for the driving machine 3, as indicated diagrammatically in FIG. 4.

Figure 5:
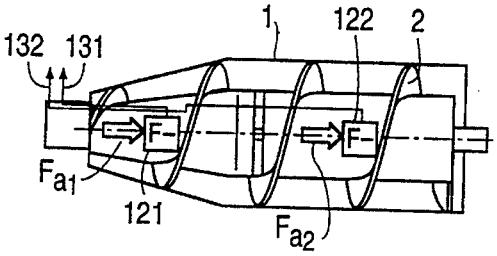

As FIG. 5 shows, the acting axial forces can also be measured at several points of the scroll 2, and the measured values can be obtained via dynamometer arrangements 121, 122 as output signals 131, 132.

Of particular interest are the axial forces on the scroll flight 2' in the conical section of the centrifuge (FIG. 4).

Figure 6:
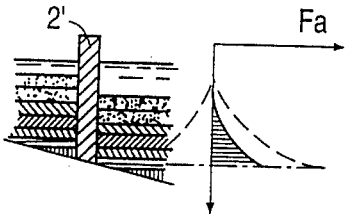
FIGS. 6 and 7 diagrammatically indicate the arrangement of the static or dynamic axial forces on the scroll flight according to FIGS. 2 and 3.

FIG. 6 shows the axial compressive force on a scroll flight 2' in the conical section of the centrifuge when the scroll is standing still relative to the shell 1, that is, the difference between scroll rpm and shell rpm is zero. The density variation between the face and the rear end of the scroll generates a differential pressure which increases upon increasing concentration and increasing diameter, the force Fa resulting on the flight 2' increases thereby once again with increasing diameter. Thus it can be said that this force is to a large extent a function of the density of the zone that is found in the region of the greatest diameter. This axial force upon the flight is the static axial force, and this can only be determined when the scroll is standing still, relative to the shell.

Such static axial forces can, for instance, be used as a reference signal for the control.

Figure 7:
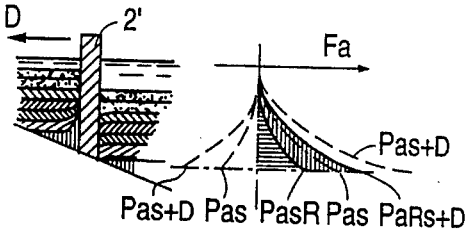

Upon a rotation of the scroll, shearing forces also occur which are directly proportional to the speed of the scroll. FIG. 7 shows how the dynamic pressure adds to the static pressure upon the flight 2' when the flight pushes the sediment in direction D. Thereby, a bulge of solids forms at the front of the flight, which becomes larger the more dense the sediment and the faster the speed of the scroll is, whilst the solids form a slope at the rear side of the flight. Thus the shearing work also changes the static pressure, the increase of this static pressure being dependent on the scroll speed, and may thereby be added in the bounds of the dynamic pressure.

Thus the dynamic axial force gives information about the density of the zone that is found in the region of the shell radius, the determined axial force forming thereby an addition of the static axial force and the dynamic axial force when the scroll is running. To determine the dynamic axial force, the static axial force has to be fed in as the control advance value, either as empirical value or by a periodical measuring when the scroll is at standstill.

For a control of the scroll speed, the scroll speed is regulated proportionally to the dynamic axial force on the scroll. Such a control system allows a solids throughput that is constant in dryness over a wide area. However, this control can of course be subject to precisely the same instability phenomena that also occur in the case of the control that is dependent on torque.

In the case of a dynamic control dependent on axial force or on scroll torque, the scroll speed is, however, so out of adjustment in the working point that the ratio of dynamic axial force to torque remains constant for a longer period of time. Such a control forces the centrifuge to a geometrically similar distribution of solids, also with variable solids loading, thus preventing feedbacks in the control. Such a control thus permits a stable flow even when the sediment density is high. Moreover, in order to avoid determining the static axial force on the scroll, the scroll speed can be adjusted such that the differential quotient from the time change of the total axial force and the time change of the torque remain constant for a longer period of time.

The quotient from the dynamic axial force and the torque is, at a constant rotational speed of the bowl and the same specific addition of flocking agents, a solids constant and gives information about the condensability or "scrollability".

If a variable, free scroll drive exists, a control of the rotational speed of the bowl can be carried out in addition to the control of the rotational speed of the scroll. This permits, via the additional control of the rotational speed of the bowl, a constant ratio of dynamic axial force and torque to be achieved in order to counter thereby fluctuations due to changes of the density.

The specified measures thus permit a control that generates a constant static axial scroll load. Such a control system is very interesting in connection with so-called greasy sediments, which are very voluminous and solidify only with difficulty. Such sediments create very low torques, which, as already mentioned, are greatly influenced by dynamic disturbance variables. Nevertheless, however, the static axial scroll load generates forces which are, from the amount, very easily measurable, especially if they are determined for the entire scroll, and which are dependent only on the density of the zone in the region of the shell in the conical section of the machine. Therewith, an elegant and sensitive density measurement or control can be accomplished.

Thus, from the aforesaid there results an optimal control of the centrifuge here in question.

With this, neither the control circuit arrangement nor the determining of the axial forces or components thereof on the scroll is problematic, for the purpose of which, suitable detecting elements, electronic or hydrostatic sensors, are available. Equally, determining the axial forces acting section-wise or on the entire scroll can be accomplished via one or several axial bearings having axial force sensors, or by means of the required operating pressure from one or several hydrostatic axial bearings.

Figure 8:
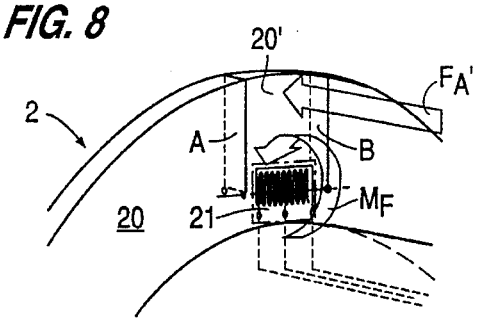
FIG. 8 is a fragmentary perspective schematic view of a scroll including a strain gauge arranged according to the invention.

FIG. 8 illustrates a measuring arrangement for a local (spotwise) measuring of axial forces by means of expansion measuring strips (strain gauges). The scroll 2 is provided with two adjacent parallel (or radial) cuts A and B whereby a tab portion 20' of the scroll screw (vane) 20 is obtained. The locally appearing axial force $F'_A$ generates in the area between the slits A and B a torque $M_F$ and the resulting deformation (bending) of the tab 20' is measured by a measuring device 21 formed of expansion measuring strips (strain gauges). Such a measuring process yields only an approximate information on the absolute magnitude of the locally present axial force since the conversion of the axial forces into a torque $M_F$ depends from the leverage length of the individual points on the scroll 2 where the axial forces appear. Since, however, the largest forces always appear at the outermost scroll zone and with decreasing radius they rapidly become imperceptible, such a measuring process is acceptable in all respects.

Figure 9:
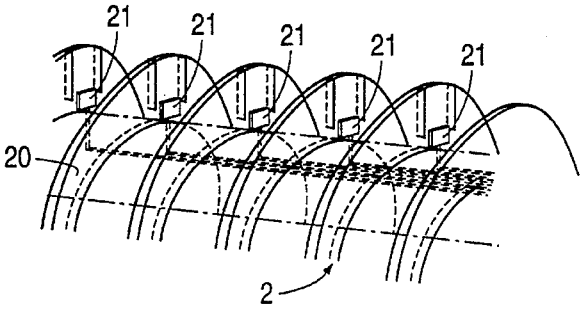
FIG. 9 is a fragmentary perspective schematic view of a scroll showing several turns each provided with a strain gauge of the type shown in FIG. 8.

FIG. 9 shows the measuring arrangement of FIG. 8 for a plurality of consecutive turns of the scroll screw. The measuring results obtained with such an arrangement permit to draw conclusions concerning the "longitudinal sedimentation profile" of the centrifuge. Such conclusions present a valuable information concerning the dehydration process of heavy suspensions.

Figure 10:
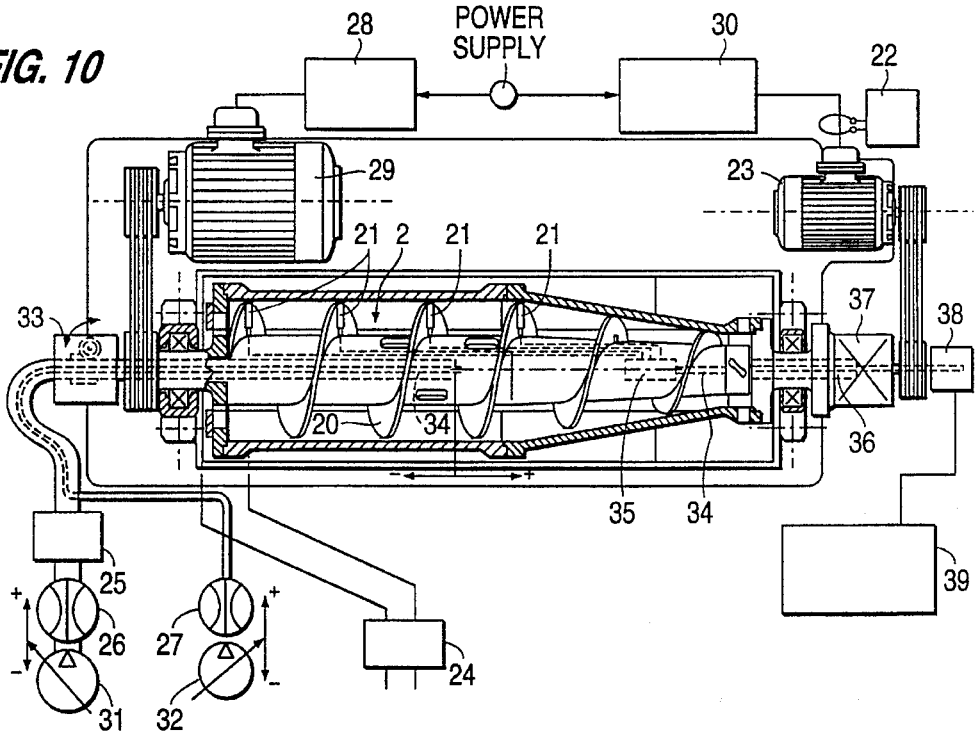
FIG. 10 is a schematic, partially sectional view, with block diagram, of a preferred embodiment of the invention including electric drive for the centrifuge shell and the centrifuge scroll.

FIG. 10 illustrates the entire centrifuge whose scroll 2 has, on each turn of the scroll screw 20 a measuring device 21 as shown in FIG. 8. The centrifuge has the following additional measuring data sensing or evaluating features:

The measuring device 22 measures the current $I_{eff}$ of the scroll-driving motor 23 whose current is proportionate to the scroll torque. At the measuring device 24 the opaqueness of the concentrate is measured whereas at the measuring device 25 the inlet concentration n of the solids in the liquid is sensed. At the measuring device 26 the inlet quantities $V_s$ of the product and at the measuring device 27 the inlet quantities of the flocculent solution $V_P$ are measured.

The above-discussed measuring devices are coupled with regulating and setting devices such as, for example, a frequency converter 28 of the driving motor 29 for the drum (bowl shell) 1, a frequency converter 30 which is associated with the driving motor 23 for the scroll 2 and which controls the differential rpm (that is, the rpm difference between drum and scroll), the regulating pump 31 which controls the supply quantities of the product, the regulating pump 32 which controls the supply quantities of the flocculent solution and the device 33 which senses the penetration depth of the supply pipe 34. The cooperation of these measuring and regulating devices will be discussed later as the specification progresses.

In the spotwise measuring of the axial force a significant difficulty resides in extracting the measuring magnitudes from the rotating system. .

In the illustrated embodiment the individual strain gauges (individual torque measuring devices) 21 are connected to an amplifying and collecting device 35 and therefrom the signals are directed through the tube 34, the scroll shaft stub 36 and the gear 37 to the stationary receiver 38 and therefrom to an external evaluating device 39.

Figure 11:
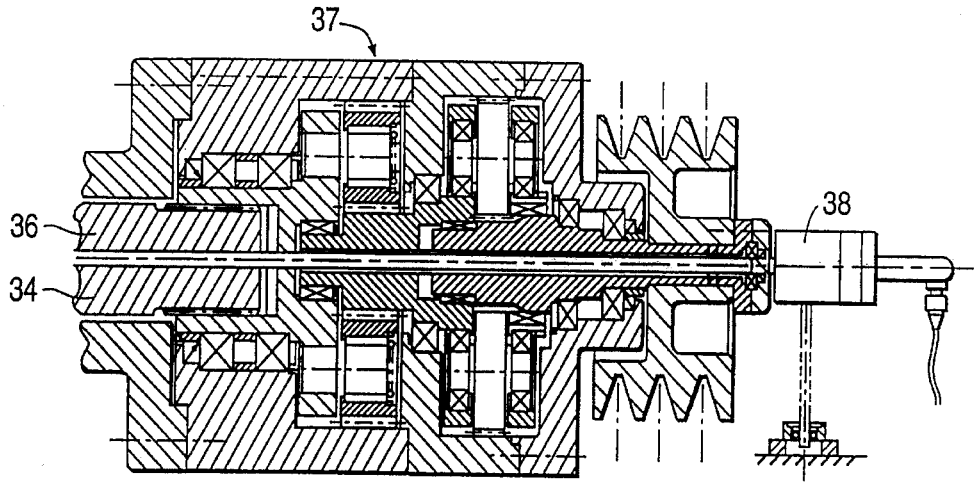
FIG. 11 is an enlarged sectional view of a part of the structure shown in FIG. 10.

FIG. 11 shows the passage of the information carrying tube 34 through a two-stage planetary gear 37. The tube 34 also includes the feed conductor for the amplifier and collecting device 35, since the latter, because of evaluation and operational reasons do not admit a built-in, autonomous power source. To avoid the disturbance-prone and maintenance-intensive slide ring and brush contacts in the centrifuge which often operate at high rpm's, a built-in a.c. current generator (discussed in more detail in connection with FIG. 12) is disposed in the receiver 38.

Figure 12:
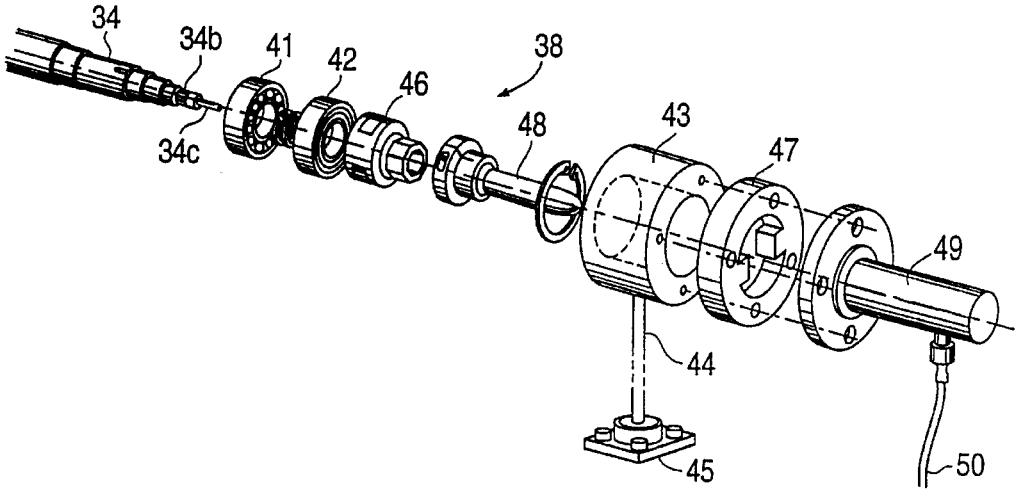
FIG. 12 is a perspective exploded view of components within the scroll of the structure shown in FIG. 10 for signal transmission from rotary to stationary components.

FIG. 12 illustrates the receiver 38 in an exploded view, together with the cable carrying tube 34 to the end of which the entire stationary part is floatably suspended by roller bearings 41 and 42. The housing 43 is supported against rotation by an arm 44 anchored in an elastic holder 45. The armature of the generator 46 is secured fixedly to the tube 34 in an electrically connecting manner and rotates in the permanent magnet stator 47.

On the armature part an antenna bar 48 is centrally mounted and is connected with the inner conductor 34*c* of the coaxial cable 34*b*. The transmitting antenna bar 48 rotates in the receiving antenna tube 49 whose signals are guided by a shielded cable 50 to the evaluating device 39 (shown in FIG. 10).

Figure 13:
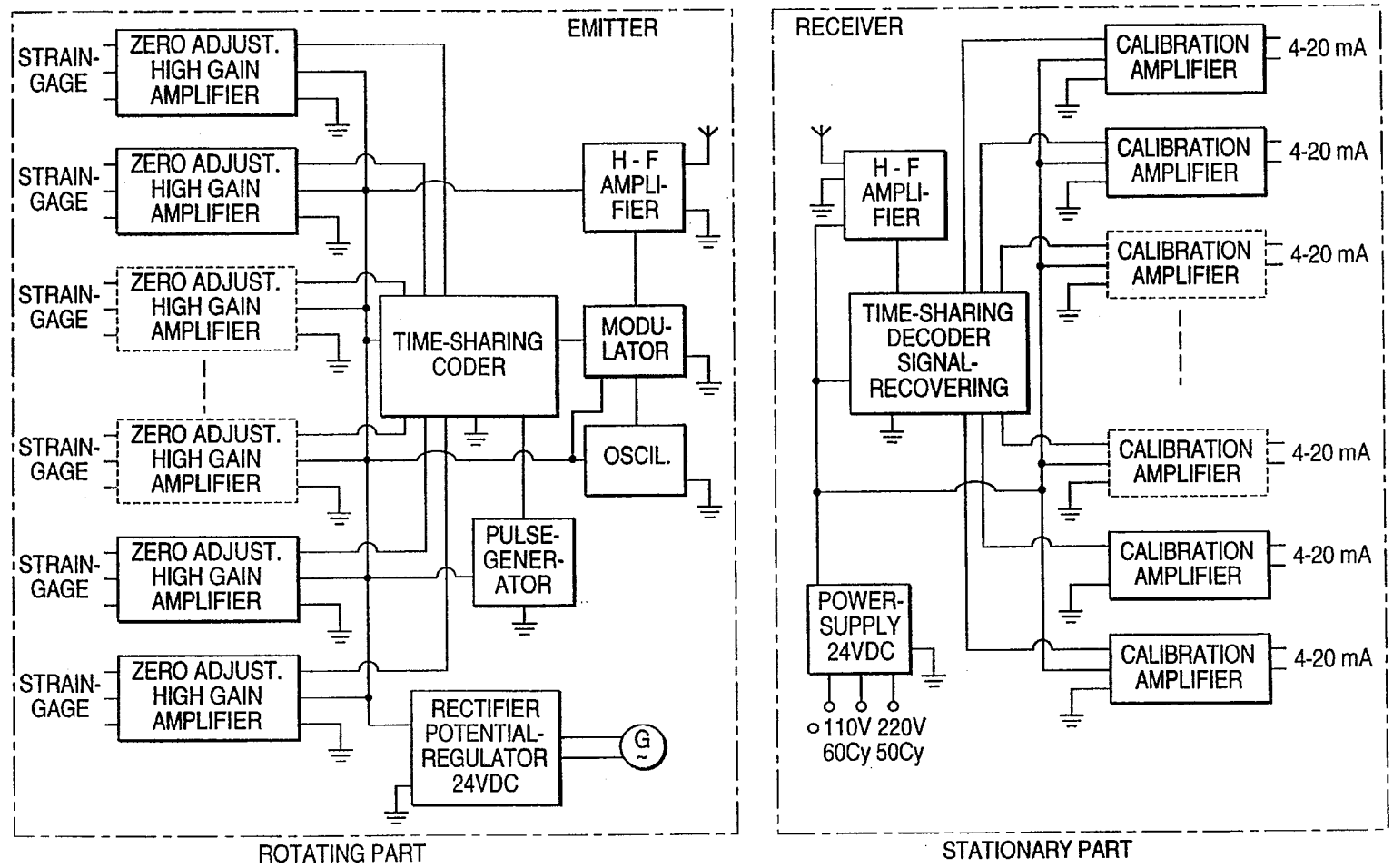
FIG. 13 is a block diagram of an information transmitting system for the construction shown in FIG. 10.

FIG. 13 illustrates a block diagram of the information transmitting system. In the emitter portion the generator is connected to a rectifier and a voltage regulator connected to inputs of amplifiers and collecting devices. The time sharing process permits the transmission of high information densities and is best adapted to evaluate, in addition to the individual strain gauges associated with the axial force measurement, additional measuring systems such as supersonic or electron-optical systems. It is also feasible to use a waveguide for transmitting signals instead of a carrier frequency according to the presently described embodiment.

In the description which follows, the hydrostatic measurement of the entire axial load on the scroll 2 will be set forth.

Figure 14:
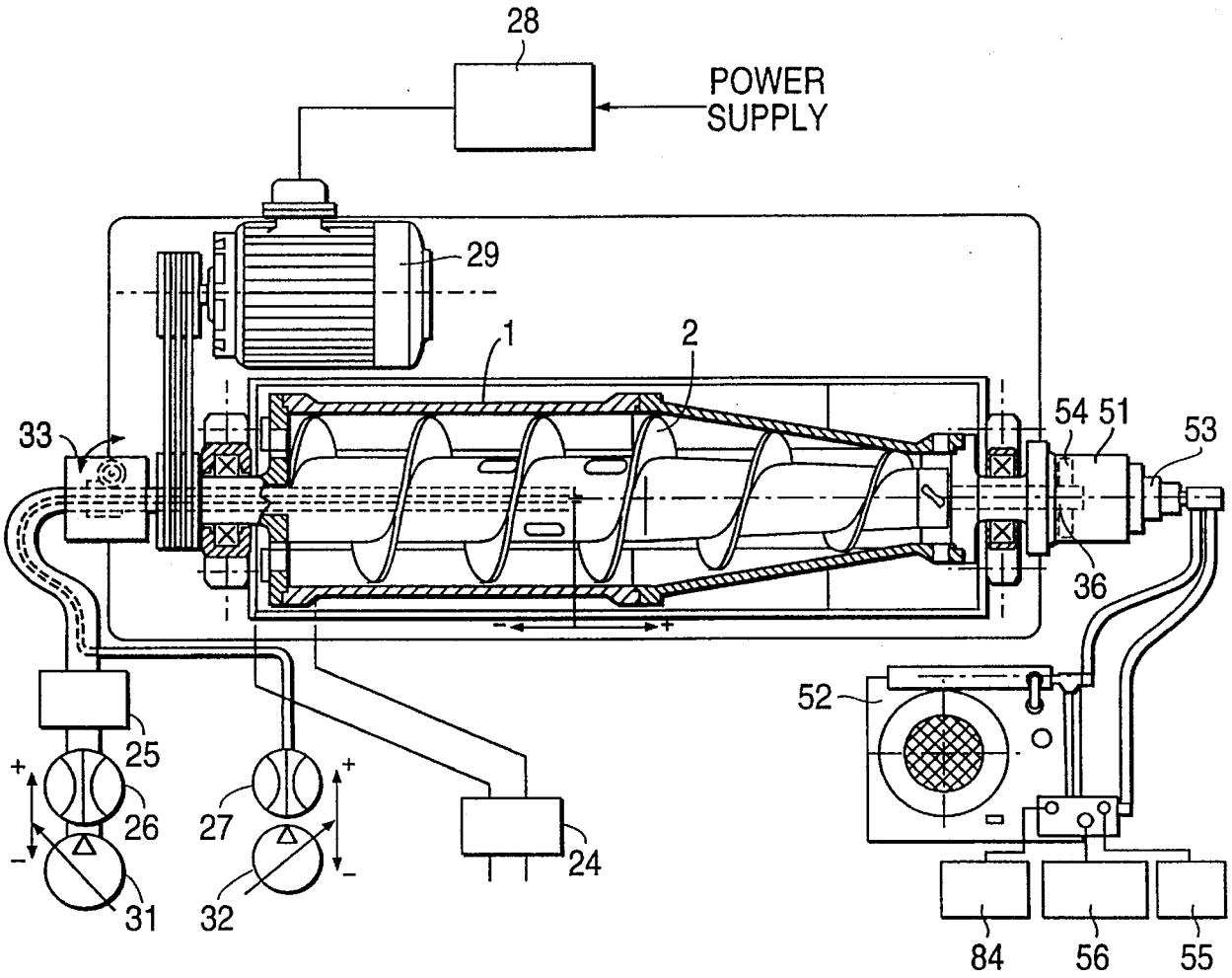
FIG. 14 is a schematic, partially sectional view, with block diagram, of a preferred embodiment of the invention showing an electric motor drive for the centrifuge shell and a hydraulic motor drive for the centrifuge scroll.

Turning to FIG. 14, there is illustrated therein the entire centrifuge provided with a hydrostatic measuring system. Instead of the arrangement shown in FIG. 10 which shows a so-called "back-drive" system (an electromotor and gearing rotated thereby) for driving the scroll, the scroll drive in this embodiment is formed of a slowly rotating, large-torque hydraulic motor 51 whose rotor is connected with the scroll shaft stub 36 and whose housing is, in turn, secured to the drum (bowl shell) 1 of the centrifuge. The motor 51 generates a differential rpm of the scroll rpm and the drum rpm; the amount of the differential rpm corresponds to the feed quantities of the pump aggregate 52 and is admitted by a high pressure rotary passage 53. In the housing of the hydraulic motor 51 a hydrostatic axial bearing 54 is located which carries the entire axial load of the scroll 2 and whose operational pressure corresponds to the total axial force and is transmitted to the measuring device 55 as a representative signal. At the aggregate 52 the feed pressure of the hydraulic motor 51 is measured; this pressure corresponds to the torque M which is applied to the scroll 2. The other measuring devices for the different magnitudes, such as regulating and setting devices as well as the differential rpm setting device 56 are identical to the system shown in FIG. 10.

Figure 15:
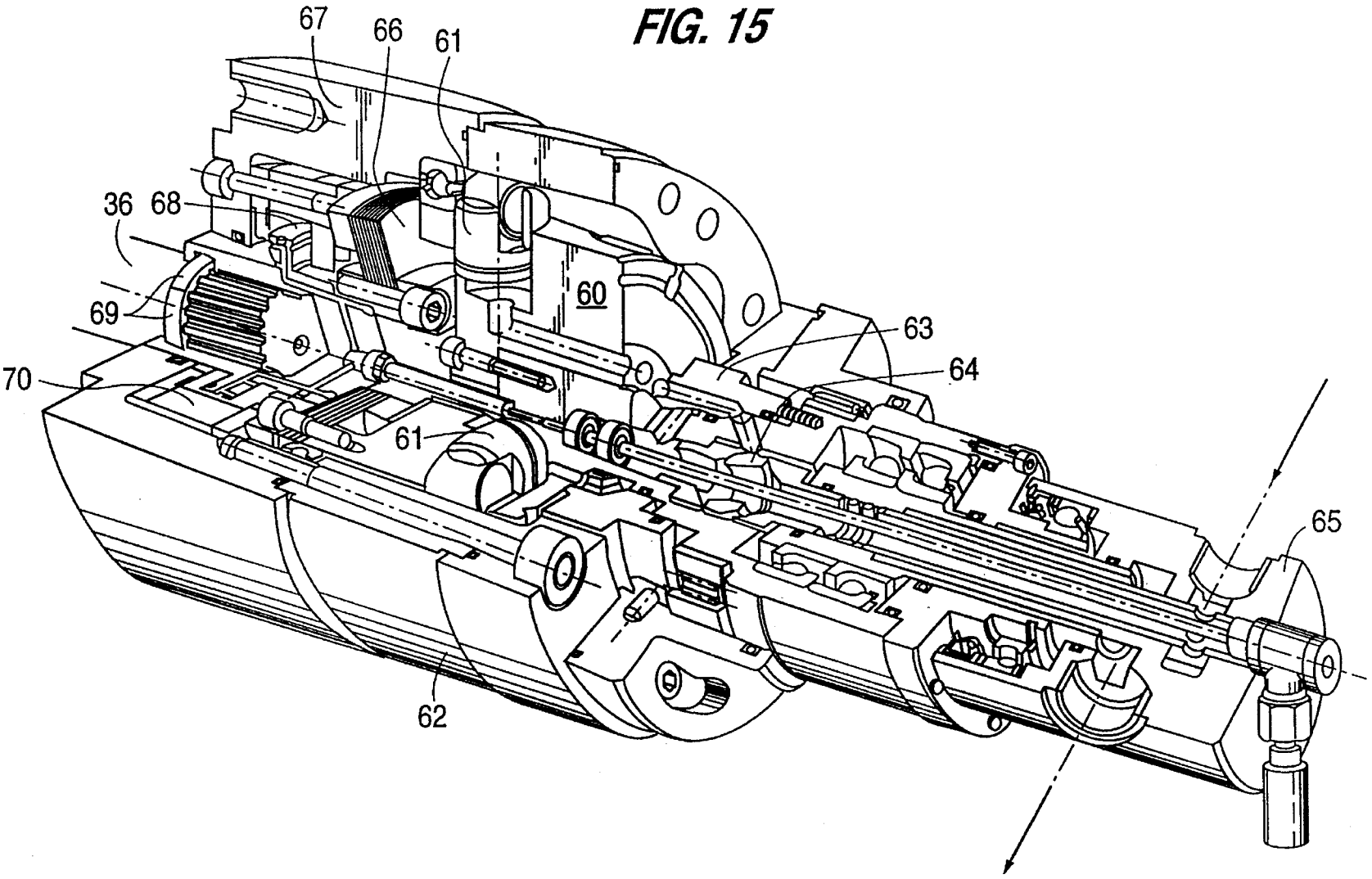
FIG. 15 is a perspective cutout view on an enlarged scale of details of a hydraulic motor forming part of the construction shown in FIG. 14.

FIG. 15 shows such a hydraulic scroll drive. The hydraulic motor proper is a "radial roller piston motor" having a rotor 60 whose pistons 61 roll on a cam track disk 62. The cylinders of the rotor 60 are alternatingly connected with the feed line and the return line via a distributor 63. The rotary pass-through 64 connects the pressure path between the stationary part 65 and the rotary part 66.

In the mounting flange 67 oriented towards the centrifuge there is located a hydrostatic axial bearing whose rotary part 68 is connected with the scroll stub 36 by means of segmented rings 69 to resist pulling forces. The stationary part of the axial bearing 70 is countersupported by the mounting flange 67. The connection of the hydrostatic bearing part 68 with the rotor 60 of the hydraulic motor is effected by an axially flexible connection 66 to ensure that the hydraulic motor does not interfere with the sensing of the axial forces. A sliding connection, such as a splined shaft would be disadvantageous because in case a large torque is transmitted, substantially large axial frictional forces would be generated which in turn would result in a significant mechanical hysteresis. The hydrostatic axial bearing 68, 70 has to be dual acting so that in case the direction of rotation of the hydraulic motor is reversed (for example, in case of a clogged machine) the reversal of load can be handled without difficulties.

Figure 16:
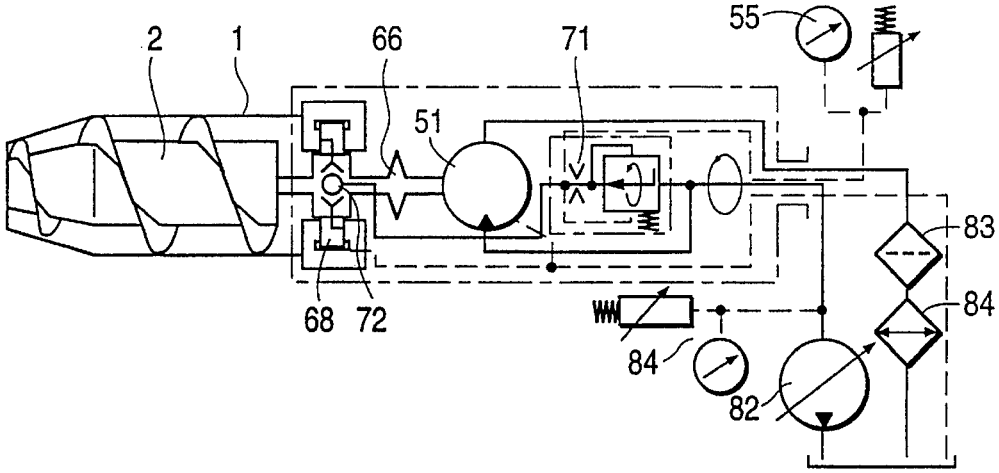
FIG. 16 is schematic axial view of a centrifuge with sensor and control means according to a further embodiment of the invention.

Turning to FIG. 16, there is illustrated therein the entire hydraulic system for operating the centrifuge. The feeding of the hydrostatic axial bearing is effected via a branch from the feed of the hydraulic motor 51 by means of a two-way flow rate regulating valve 71. Such an arrangement is satisfactory because a large axial force can appear only at the scroll 2 in case of a large torque but not conversely.

Figure 19:
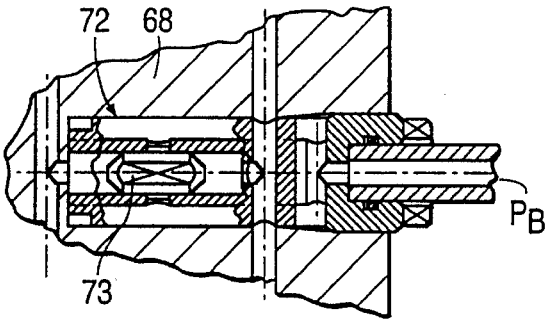
FIG. 19 is an enlarged fragmentary sectional view of a detail of the construction shown in FIG. 16.
Figure 18:
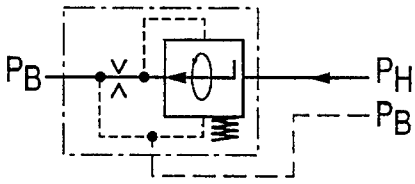
FIG. 18 is a diagrammatic view of the operation of the construction shown in FIG. 17.

The hydraulic motor 51 is coupled with the rotary part 68 of the hydrostatic axial bearing by means of the axially flexible rotary connection 66. In the axial bearing part 68 a switching valve 72 is contained which continuously connects the supply line of the bearing with the loaded side of the axial bearing and thus is capable of handling a reversal of loads. As seen in FIG. 19, the stable closed position of a shuttle 73 of the switching valve 72 always lies on the side of the branch with the smallest hydrostatic resistance. In addition to the rotary system, there is provided a pumping aggregate with a regulating pump 82, the return conduit for the hydraulic motor with the return grid 83 and the oil cooler 84. At the pressure outlet of the pump 82 there is arranged a pressure measuring device 84 and at the conduit to the hydrostatic axial bearing 68, 70 there is provided the measuring device 55.

Figure 17:
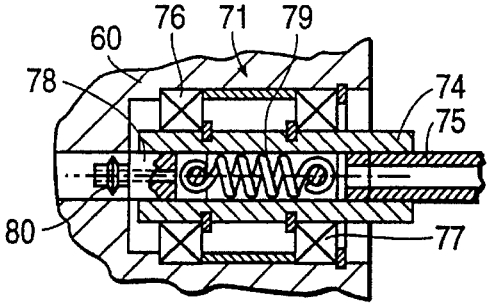
FIG. 17 is an enlarged sectional view of further details of the structure of FIG. 16.

As shown in FIG. 17, the two-way flow rate regulating valve 71 which branches the bearing feed from the hydraulic motor feed, includes a valve body 74 which is rotationally fixedly connected with the non-rotating part 65 (not shown in FIG. 17) by means of a small tube 75 and is coupled centrally with the rotary body 60 of the hydraulic motor by means of bearings 76 and 77. The regulating slide 78 which is coupled to the valve body 74 by a tension spring 79, carries a valve head 80 which determines the fixed flow regulating resistance by cooperating with a bore in the rotor block 60. The pressure $P_B$ prevailing at the hydrostatic bearing is also present in the chamber of the spring admitted thereto through a central bore of the regulating slide 78. From the spring chamber the pressure is transmitted to a measuring device 55 through the tube 75.

The systems disclosed particularly in conjunction with FIGS. 10 and 14 are adapted to measure both dynamic and static axial forces. For the measuring of axial forces no special measuring devices are required; such static axial forces are measured by the same apparatus as that used for measuring the axial forces. Such a static axial force measurement occurs during a short-period constant state of the differential rpm (that is, the rpm difference between the scroll and the drum) while the drum rpm remains unchanged.

It will be understood that the above description of the present invention is susceptible to various modifications, changes and adaptations, and the same are intended to be comprehended within the meaning and range of equivalents of the appended claims.

What is claimed is:

1. In a method of controlling at least one of a plurality of regulating parameters affecting results of separation of a suspension into clarified liquid and solids in a centrifuge; including the step of providing a rotatably supported outer bowl shell, a scroll supported in the outer bowl shell for rotation relative to the outer bowl shell to transport solids relative to the outer shell, an inlet for introducing the suspension into said outer bowl shell for separating treatment by the centrifuge, a first outlet for removing the clarified liquid from the outer bowl shell, a second outlet for removing the solids from the outer bowl shell, means for rotating said outer bowl shell, means for rotating said scroll, and means for rotating said outer bowl shell and said scroll at a differential rpm, said differential rpm being one of the regulating parameters;

the improvement comprising the steps of (a) measuring an axial force imparted on said scroll; said axial force being oriented parallel to an axis of rotation of said scroll;

(b) generating feedback signals from values obtained in step (a); and (c) controlling said at least one regulating parameter of the centrifuge as a function of said feedback signals.

2. The method as defined in claim 1, wherein said measuring step comprises the step of measuring an axial force imparted in a predetermined spot of said scroll.

3. The method as defined in claim 1, wherein said scroll includes a scroll screw; further comprising the step of providing at least one tab portion defined by a pair of spaced slots provided in the scroll screw; said measuring step comprises the step of measuring an extent of deformation of said tab portion.

4. The method as defined in claim 1, wherein said measuring step comprises the step of measuring axial forces imparted on a plurality of locations of said scroll.

5. The method as defined in claim 1, wherein said measuring step comprises the step of measuring an axial static force.

6. The method as defined in claim 1, wherein said measuring step comprises the step of measuring a sum of static and dynamic axial forces.

7. The method as defined in claim 1, wherein one of said regulating parameters is the rpm of the scroll; further comprising the steps of determining an axial dynamic force imparted on said scroll and controlling the rpm of said scroll as a function of said axial dynamic force.

8. The method as defined in claim 1, further comprising the steps of (d) measuring a torque imparted on said scroll;

(e) generating feedback signals from values obtained in step (d); and (f) controlling the rpm of said scroll as a function of the feedback signals obtained in step (e).

9. The method as defined in claim 1, wherein step (c) comprises the step of controlling said differential rpm.

10. The method as defined in claim 9, wherein step (c) further comprises the step of maintaining constant an axial force on said scroll.

11. The method as defined in claim 10, wherein one of said regulating parameters is the rpm of the scroll; further wherein the step of maintaining constant an axial load on said scroll includes the step of controlling the rpm of said scroll.

* * * * *